US006378474B1

(12) United States Patent
Pierik

(10) Patent No.: US 6,378,474 B1
(45) Date of Patent: Apr. 30, 2002

(54) VARIABLE VALUE TIMING MECHANISM WITH CRANK DRIVE

(75) Inventor: Ronald Jay Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/482,260

(22) Filed: Jan. 13, 2000

Related U.S. Application Data

(60) Provisional application No. 60/136,988, filed on Jun. 1, 1999.

(51) Int. Cl.[7] ..... F01L 13/00

(52) U.S. Cl. ..... 123/90.16; 123/90.17

(58) Field of Search ..... 123/90.15, 90.16, 123/90.17, 90.22, 90.31, 90.6

(56) References Cited

U.S. PATENT DOCUMENTS 5,680,837 A * 10/1997 Pierik ..... 123/90.17
5,937,809 A * 8/1999 Pierik et al. ..... 123/90.16
6,019,076 A * 2/2000 Pierik et al. ..... 123/90.16
6,029,618 A * 2/2000 Hara et al. ..... 123/90.16
6,041,746 A * 3/2000 Takemura et al. ..... 123/90.16
6,055,949 A * 5/2000 Nakamura et al. ..... 123/90.16
6,123,053 A * 9/2000 Hara et al. ..... 123/90.16

* cited by examiner

*Primary Examiner*—Wellun Lo
(74) *Attorney, Agent, or Firm*—John VanOphem

(57) ABSTRACT

A crank driven VVT mechanism includes single or dual cranks for actuating oscillating cam drive mechanisms. The crank drive positively actuates the mechanisms in both valve opening and valve closing directions and thus avoids the need to provide return springs as are generally required in cam driven mechanisms to bias the mechanisms toward a valve closed position. However, the crank driven mechanisms of the invention require the oscillating cams to pivot onto the base circle portion during a dwell period in order to provide periods of valve closed engine operation even when the valves are set for maximum opening stroke. Thus, increased motion of the actuating mechanism or a smaller angular extent of the valve lift portions of the oscillating cams is required as compared to a cam driven mechanism. A variable ratio slide and slot control lever drive as well as a back force limiting worm drive for the control shaft are combined with the crank mechanism to provide additional system advantages comparable to those of cam actuated mechanisms.

13 Claims, 8 Drawing Sheets

VARIABLE VALUE TIMING MECHANISM WITH CRANK DRIVE

CROSS REFERENCE TO RELATED APPLICATIONS

This application claims the benefit of U.S. Provisional Application No. 60/136,988, filed Jun. 1, 1999.

TECHNICAL FIELD

The invention relates to variable valve timing mechanisms and, more particularly, to valve actuating mechanisms for varying the lift and timing of engine valves.

BACKGROUND OF THE INVENTION

U.S. Pat. No. 5,937,809, issued Aug. 17, 1999, discloses cam driven variable valve timing (VVT) mechanisms which are relatively compact, and are applicable for operating individual or multiple valves. In these mechanisms, an engine valve is driven by an oscillating rocker cam that is actuated by a linkage driven by a rotary eccentric, preferably a rotary cam. The linkage is pivoted on a control member that is, in turn, pivotable about the axis of the rotary cam and angularly adjustable to vary the orientation of the rocker cam and thereby vary the valve lift and timing. The rotary cam may be carried on a camshaft. The oscillating cam is pivoted on the rotational axis of the rotary cam.

U.S. patent application Ser. No. 09/129,270, filed Aug. 5, 1998, now 6,019,076, discloses a similar cam actuated VVT mechanism having various additional features, including a variable ratio pin and slot control member drive providing advantageous control characteristics and a worm drive for the control shaft designed to prevent backdrive forces from overcoming the actuating force of the small drive motor. A particular embodiment of flat spiral mechanism return springs is also disclosed.

SUMMARY OF THE INVENTION

The present invention provides crank driven VVT mechanisms wherein single or dual cranks are provided for actuating the oscillating cam drive mechanisms. The crank drive is desmodromic in that it actuates the mechanisms in both valve opening and valve closing directions and thus avoids the need to provide return springs as are generally required in cam driven mechanisms to bias the mechanisms toward a valve closed position. However, the crank driven mechanisms of the invention require the oscillating cams to pivot onto the base circle portion during a dwell period in order to provide periods of valve closed engine operation even when the valves are set for maximum opening stroke. Thus, increased motion of the actuating mechanism or a smaller angular extent of the valve lift portions of the oscillating cams is required as compared to a cam driven mechanism.

The advantages of control by a variable ratio slide and slot control lever drive as well as a back force limiting worm drive for the control shaft may be combined with the crank mechanism to provide additional system advantages comparable to those of cam actuated mechanisms.

These and other features and advantages of the invention will be more fully understood from the following description of certain specific embodiments of the invention taken together with the accompanying drawings.

DESCRIPTION OF THE PREFERRED EMBODIMENT

Referring first to FIGS. 1–6 of the drawings, numeral 10 generally indicates a portion of an internal combustion engine including a valve actuating mechanism 12 operative to actuate dual inlet valves 14 for a single cylinder of an engine. Mechanism 12 includes a rotary valve actuating crankshaft 16 which extends the length of a cylinder head, not shown, of a multi-cylinder engine, of which the mechanism for only a single cylinder is illustrated. The valve actuating crankshaft 16 may be driven from the engine crankshaft by a chain or any other means which would be suitable for driving a conventional valve actuating camshaft.

Figure 2:
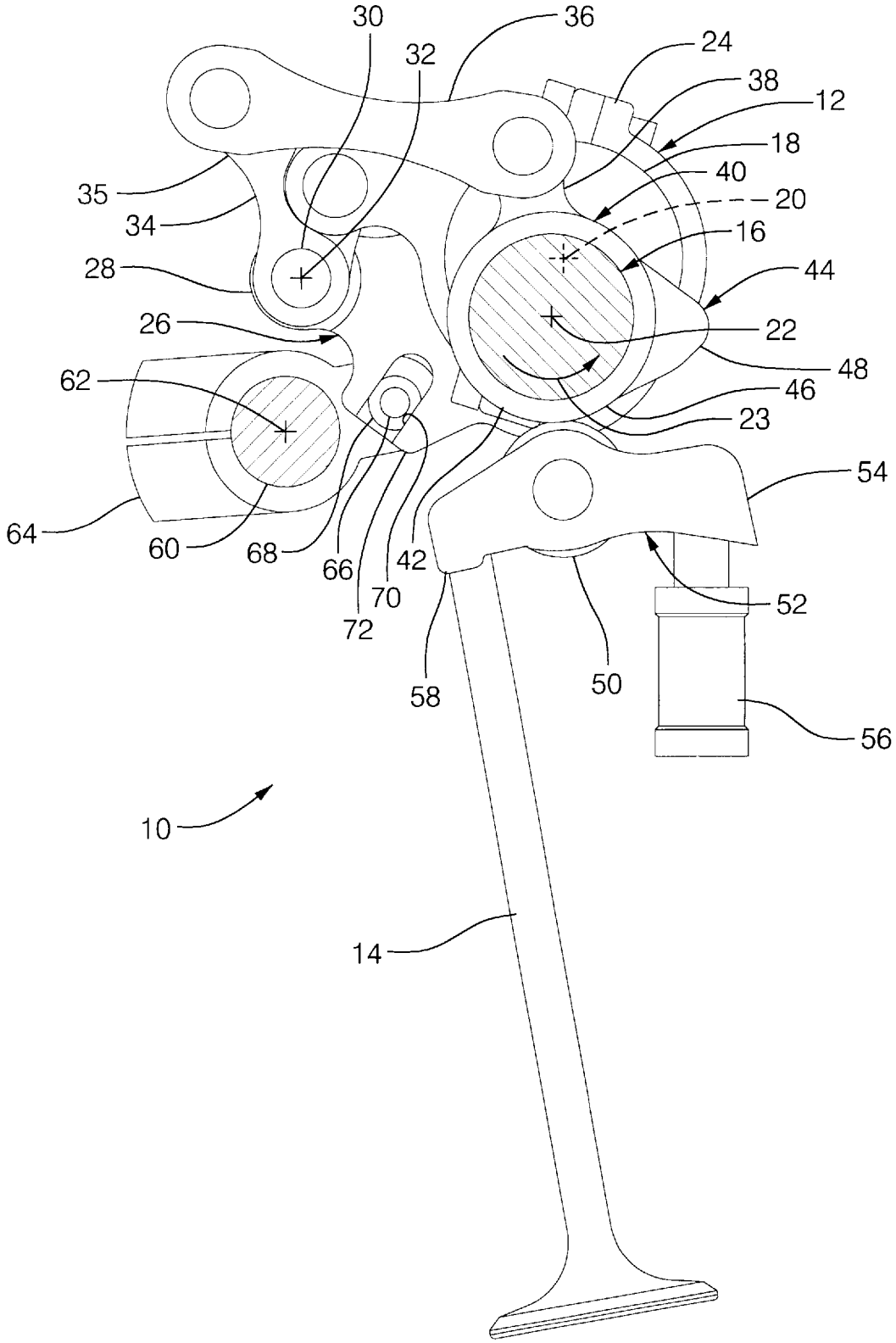
FIG. 2 is a side view of the embodiment of FIG. 1 illustrating the mechanism in an intermediate valve lift control position with the valves closed and oscillating cams in a dwell mode.
Figure 3:
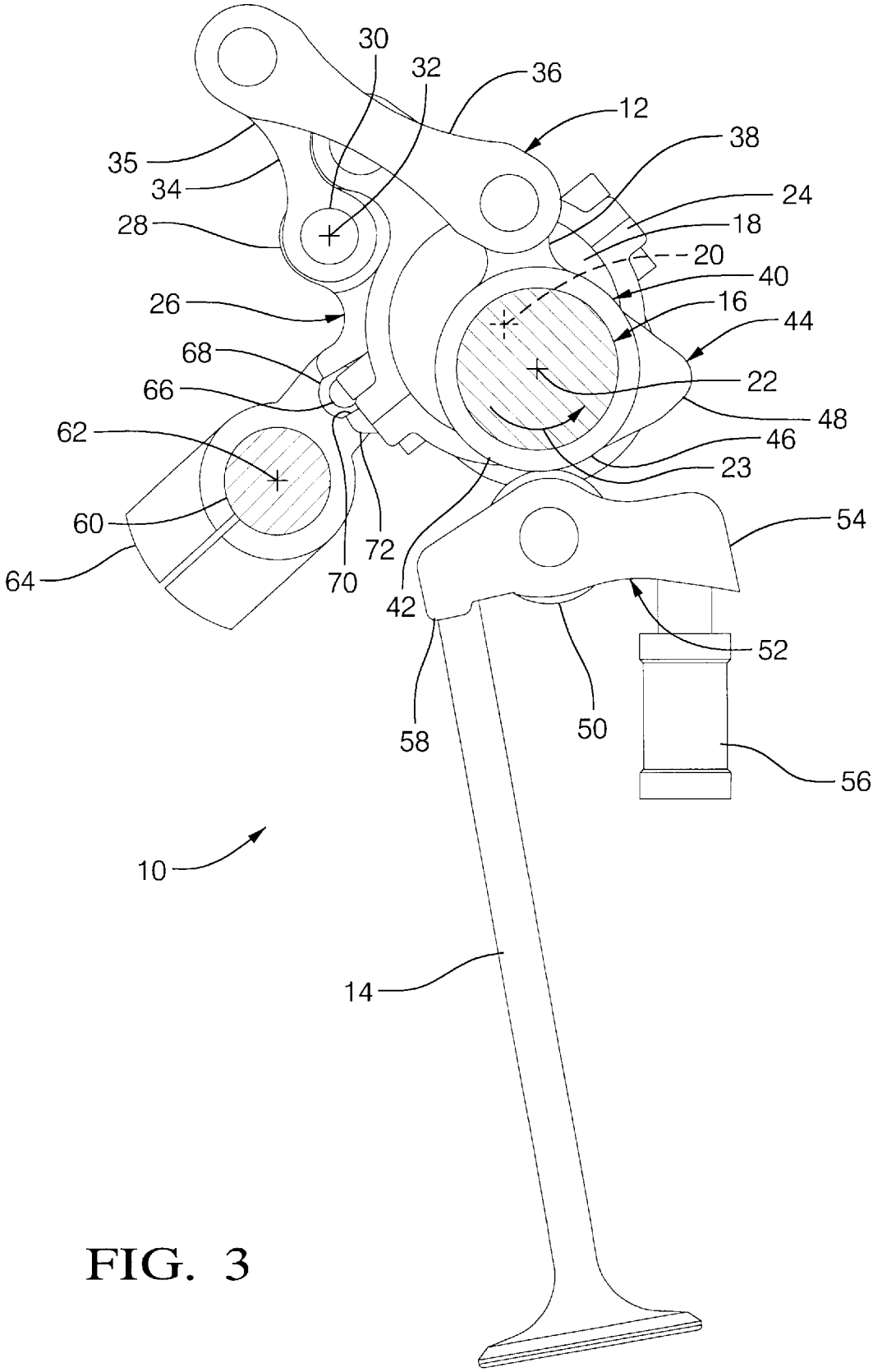
FIG. 3 is similar to FIG. 2 but shows the control shaft in a maximum valve lift position with valves closed and oscillating cams in extreme dwell.

The valve actuating crankshaft 16 carries a rotary crank or eccentric 18 having an eccentric axis 20 which orbits about a primary axis 22 of the crankshaft 16. Rotation of the crankshaft 16 is optionally counterclockwise as shown by the arrow 23 of FIG. 2, but an opposite rotation could be used if desired. A connecting rod 24 is connected with rotary crank 18 for a purpose to be subsequently described. Control members (or frames) 26 are mounted on the crankshaft 16 for pivotal motion about the primary axis 22. If desired, the control members could be mounted other than on the crankshaft. In FIGS. 2 and 3, the closer control member 26 is not shown so that the positioning of the connecting rod 24 may be clearly shown.

The control members 26 each include an outer end 28 connected with a pivot pin 30 disposed on a first pivot axis 32. A rocker lever, or primary lever, 34 is pivotally mounted at one end to the pivot pin 30 which connects it with the control members 26. A distal end 35 of the rocker lever 34 is pivotally connected by pins to links 36. Between its ends, rocker lever 34 is connected with connecting rod 24 which connects the rocker lever 34 with the crank 18 of the crankshaft 16 to positively oscillate the rocker lever 34 upon rotation of the crankshaft 16.

Dual links 36 extend from opposite sides of the rocker lever 34 to outer ends 38 of a pair of secondary levers 40 to which the links 36 are pinned. Levers 40 have inner ends 42 which are mounted on the crankshaft 16 and pivotable about the primary axis 22. These inner ends define oscillating cams 44, each having a base circle portion 46 and a valve lift portion 48. The base circle and valve lift portions are similar in concept to those discussed in the previously mentioned U.S. Pat. No. 5,937,809, although the angular extent and lift angles of the two portions are varied to accommodate the crank driven mechanism.

The oscillating cams 44 are engaged by rollers 50 of roller finger followers 52, each having inner ends 54 which are pivotally seated on stationary hydraulic lash adjusters 56 mounted in the engine cylinder head, not shown. Outer ends 58 of the finger followers 52 engage the stems of valves 14 for directly actuating the valves in cyclic variable lift opening patterns as controlled by the mechanism. Valve springs, not shown, are conventionally provided for biasing the valves in a closing direction.

In order to provide the variable valve lift and timing which are results of the mechanism, a control shaft 60 is provided that is pivotable about a secondary axis 62 parallel with and spaced from the primary axis 22. If desired, the control shaft 60 could be connected to the control members 26 by a gear and tooth connection as shown in previously mentioned U.S. Pat. No. 5,937,809 to vary the mechanism between maximum and minimum valve lift positions. However, in the present embodiments, a preferred pin and slot connection is used as shown in FIGS. 2–6. The control shaft 60 mounts a pair of control levers 64, only one being shown. Each of the control levers mounts a drive pin 66 which preferably carries a flat sided bushing 68. Each bushing 68 acts as a slider and is slidable within a slot 70 provided in an arm 72 of an associated one of the frame elements or control members 26. The slots 70 of the arms are angled with respect to a radius from the primary axis 22 in order to provide a variation in ratio of the movement between the control shaft 60 and the control member 26, as will be subsequently more fully described.

In operation of the mechanism so far described, rotation of the valve actuating crankshaft 16 orbits the crank 18 about the primary crankshaft axis 22, preferably in a counterclockwise direction as shown by the arrow 23 in FIG. 2. The crankshaft 16 always rotates in phase with the engine crankshaft, not shown, regardless of variations in the valve lift and timing events. Thus, the crank 18 oscillates the rocker lever 34 around its pivot pin 30 with a cyclic angular oscillation that is a constant function of engine crank rotation. As the rocker lever 34 is pivoted outward away from the primary axis 22, it draws the link 36 with it, in turn oscillating the secondary levers and associated oscillating cams 44 through a predetermined constant angle with each rotation of the camshaft.

Figure 4:
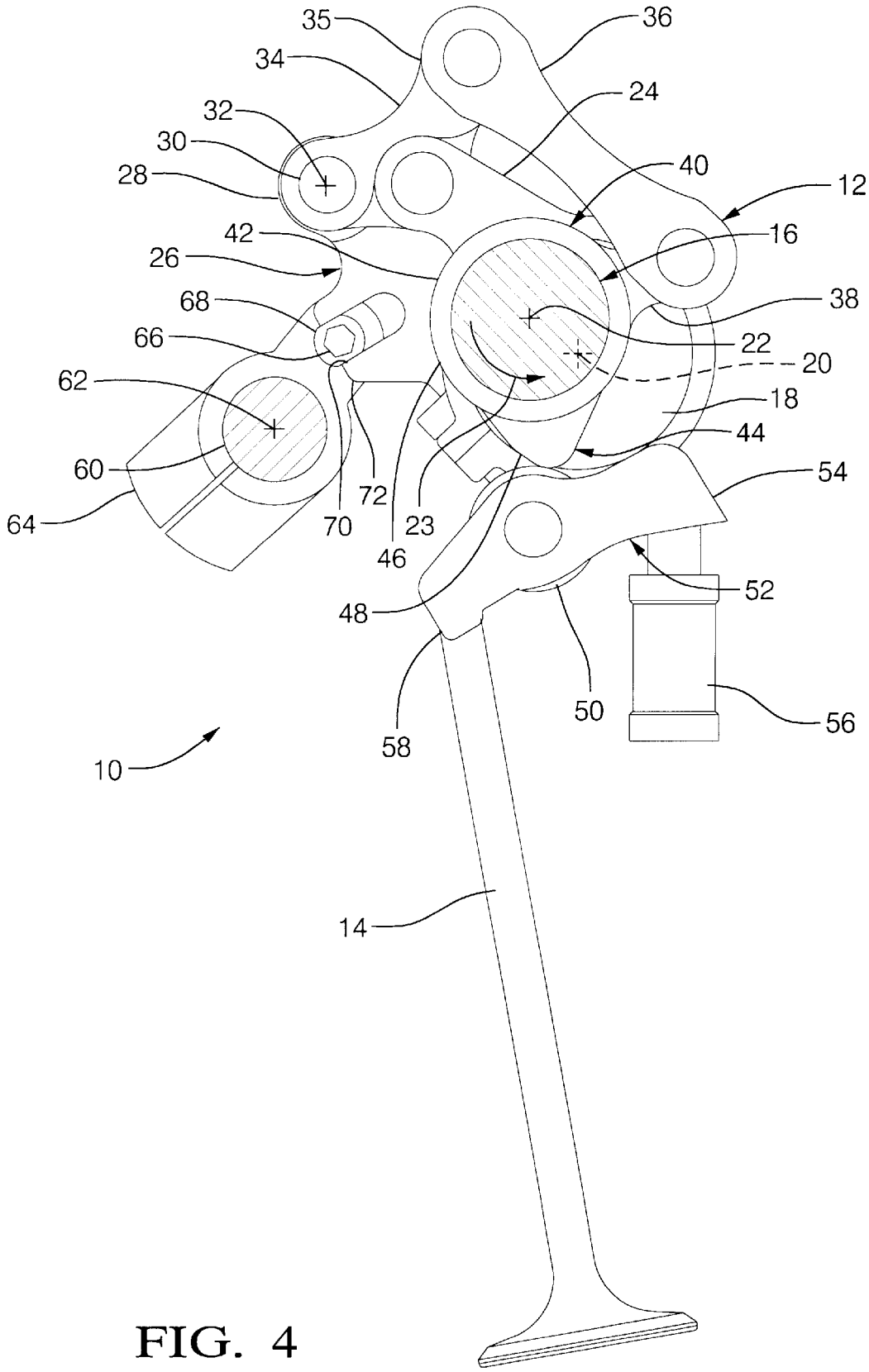
FIG. 4 is similar to FIG. 3 but shows the valves fully open and oscillating cams in the maximum valve lift position of the mechanism.

FIGS. 3 and 4 illustrate the position of the mechanism 12 with the control member 26 pivoted clockwise to the full valve lift position. FIG. 3 shows the valves 14 closed with the crank 18 rotated to oscillate cams 44 to contact follower roller 50 at the maximum dwell positions of their base circles 46. FIG. 4 shows the valves 14 fully opened with the crank 18 rotated so the noses of the oscillating cam valve lift portions 48 are engaging the rollers 50. In the full valve lift position of the control member 26, pivoting of the oscillating cams 44 by the mechanism forces the finger followers 52 downward as the oscillating cams move from their base circle locations clockwise until the nose of each cam 44 is engaging its associated follower roller 50 in the full valve lift position (FIG. 4). This causes the finger follower to pivot downward, forcing its valve 14 into a fully open position.

As the crank 18 rotates further from the full open position of the valves, the mechanism rotates the oscillating cams 44 counterclockwise, returning the finger follower rollers 50 to the base circles of the oscillating cams and thereby allowing the valves 14 to be closed by their valve springs, not shown. Continued rotation of the crank 18 rotates the cams 44 further along their base circles during a dwell condition in which the associated engine valves remain closed. Upon reaching maximum eccentricity of the crank in the valve closed position (FIG. 3), the oscillation of cam 44 is reversed. However, the valves remain in a dwell condition until the crank again reaches a position at which the cams 44 are moved off their base circles to the beginning of the valve lift portions of the cams and the valves are again opened as previously described. A useful advantage of the present crank actuated mechanism over prior cam actuated VVT mechanisms is that the mechanism cycle is completed without requiring return springs. Instead, the crank and connecting rod positively move the mechanism in both directions of oscillation, avoiding the need for springs other than the usual valve springs.

Figure 5:
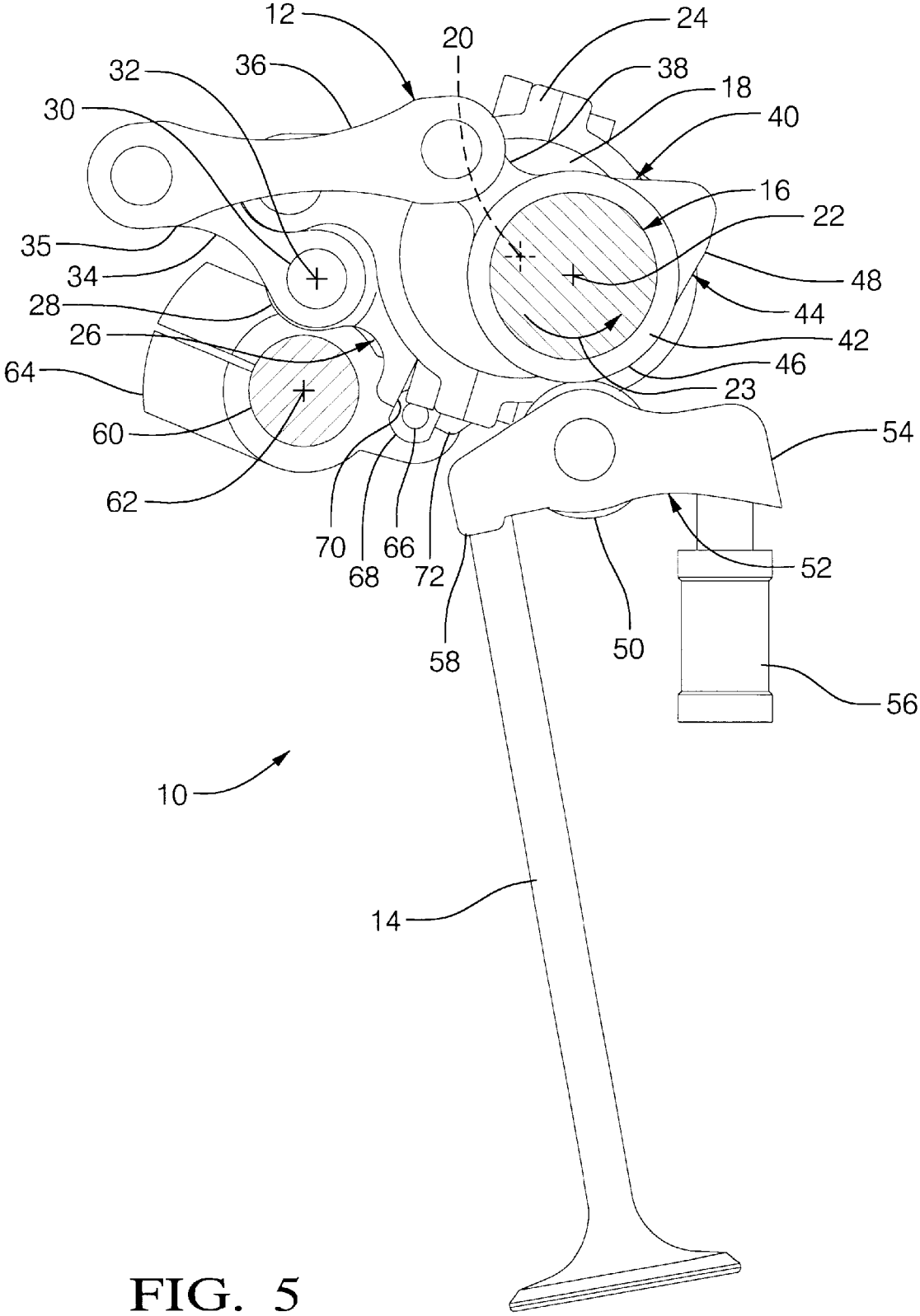
FIG. 5 is similar to FIG. 2 but shows the control shaft in a minimum valve lift position with valves closed and oscillating cams in extreme dwell.
Figure 6:
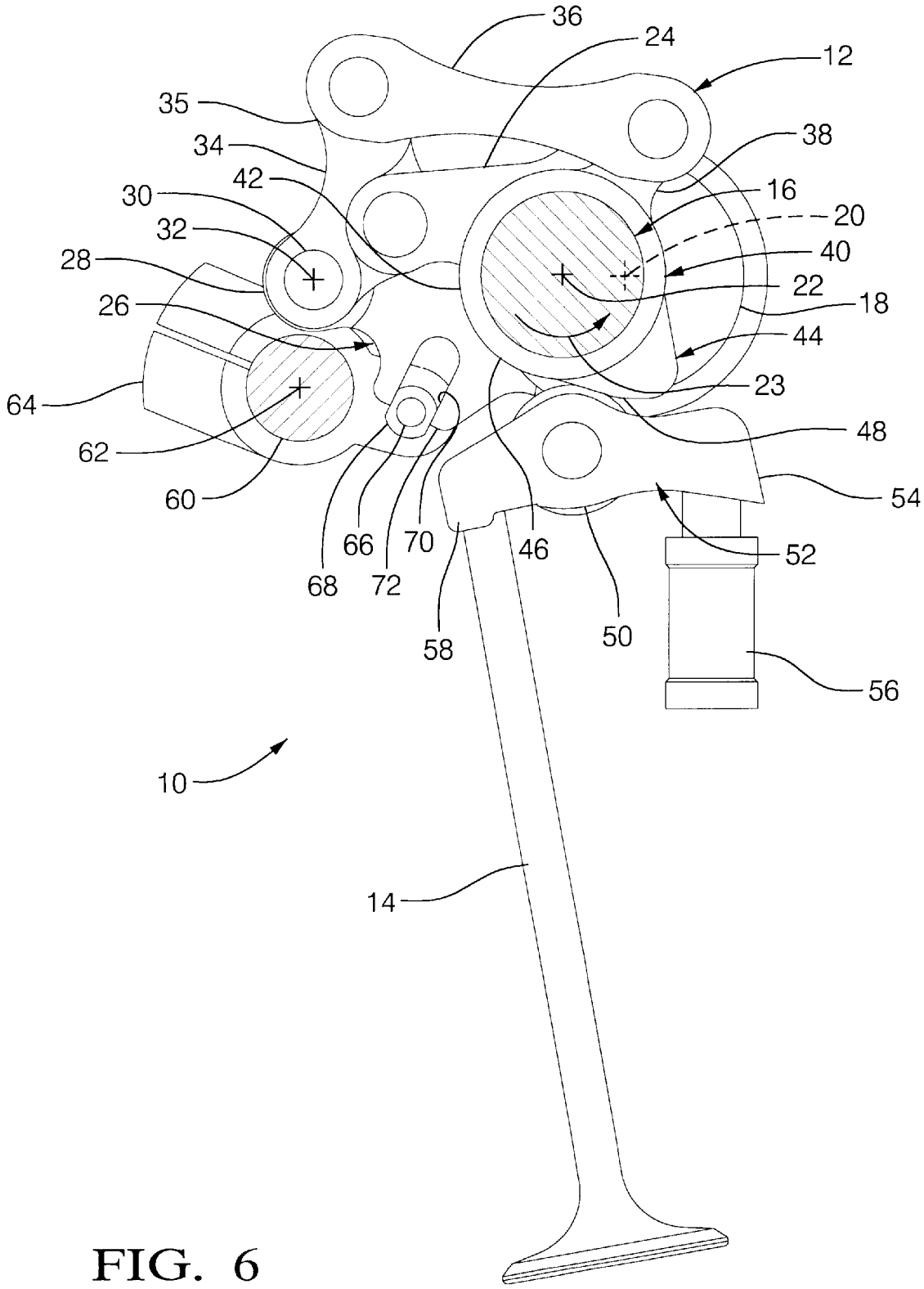
FIG. 6 is similar to FIG. 5 but shows the valves slightly open and oscillating cams in the minimum valve lift position of the mechanism.

To reduce valve lift and at the same time advance the timing of peak valve lift, the control shaft 60 is rotated clockwise, as shown in FIGS. 2–4 to the position shown in FIGS. 5 and 6 where the control member 26 is rotated fully counterclockwise. FIG. 5 shows the cams 44 in their maximum dwell position at the extreme ends of the base circles while FIG. 6 shows the cams 44 in minimum valve lift position. In this minimum valve lift position of the control shaft 60, actuation of the rocker lever 34 by the rotary crank 18 is prevented from opening the valves more that a preset minimum because the finger follower rollers 50 are in contact primarily or only with the base circle portions 46 of the oscillating cams. To accomplish this, the angular movement of the control member 22 from its full lift position of FIG. 3, must approximate the angular displacement of the oscillating cams during the valve lift portion of the stroke of the rocker lever caused by the rotary crank so that the finger follower rollers never or only slightly contact the valve lift portion 48 of the oscillating cams.

The position of the mechanism 10 about the primary axis 22 is determined by rotation of the control shaft 60 as previously described. Since the engine charge mass flow rate has a greater relative change in low valve lifts than in high valve lifts, the slider and slot connection between each control lever 64 and its control member 26 is designed so that the angled slot provides a variable angular ratio such that, at low lifts, the control shaft must rotate through a large angle for small rotation of the control member. This is accomplished by positioning the angle of the slot relative to a radial line from the primary axis 22 in order to obtain the desired change in angular ratio. With appropriate design, the ratio may be varied from about 5:1 at low lifts with a relatively rapid change toward middle and high lift positions to a ratio of about 2:1. The result is advantageous effective control of gas flow through the inlet valves over the whole range of valve lifts.

Because of the requirement of periodic valve opening and valve spring compression of each cylinder, the control shaft in a multi-cylinder engine is required to operate against cyclically reversing torques applied against the control members or frames. If the actuator was required to change the mechanism position during all of the control shaft torque values, including peak values, the actuator would need to be relatively large and expensive and consume excessive power to obtain a reasonable response time.

Figure 7:
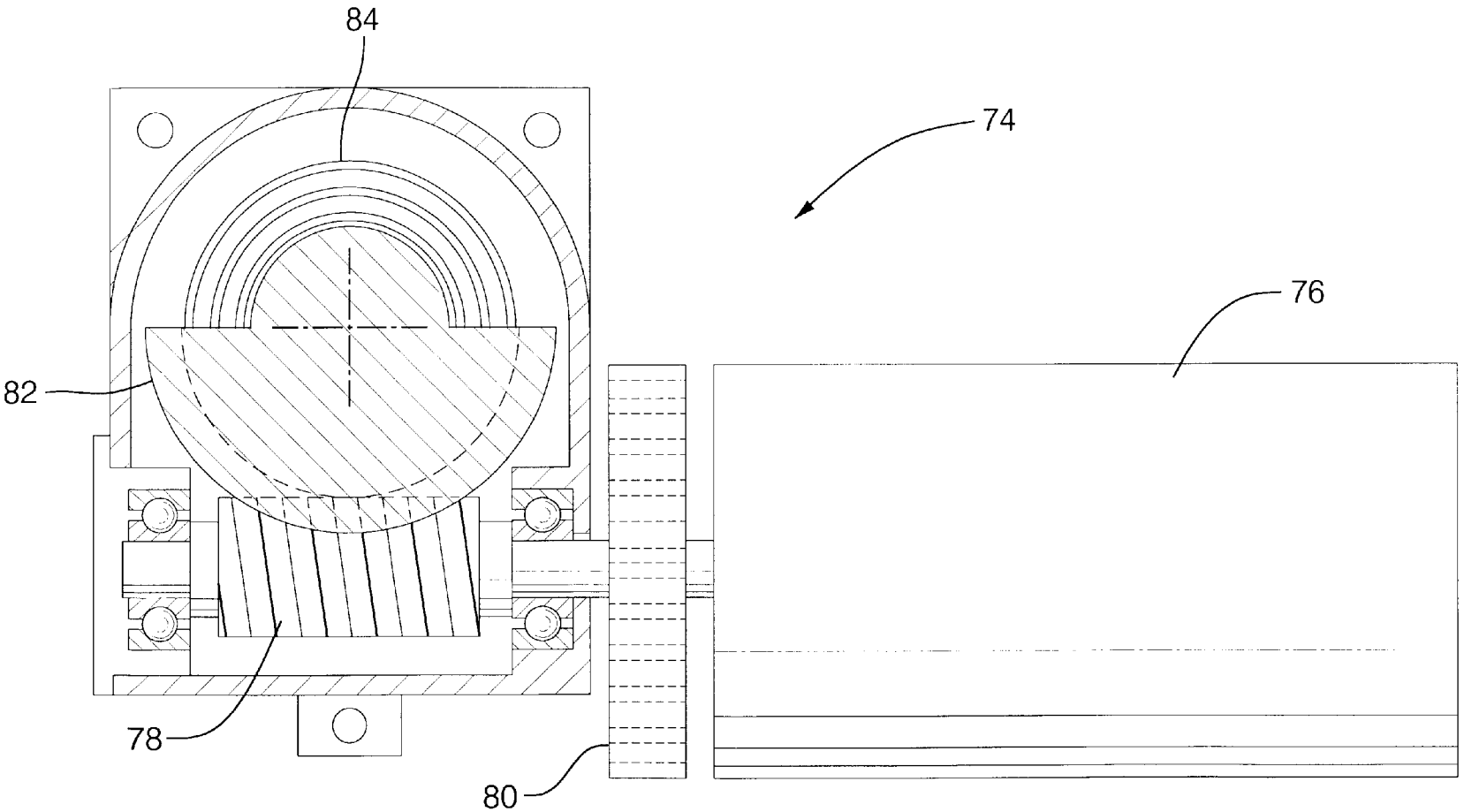
FIG. 7 is a cross-sectional view of a worm drive for actuating the control shaft of the mechanism.

To avoid this, FIG. 7 illustrates a worm gear actuator 74 applied for driving the control shaft 60 to its various angular positions. Actuator 74 includes a small electric drive motor 76 driving a worm 78 through a shaft that may be connected with a spiral return spring 80. The worm 78 engages a worm gear 82 formed as a semi-circular quadrant. The worm gear is directly attached to an end, not shown, of a control shaft 60 for rotating the control shaft through its full angular motion. The pressure and lead angles of the teeth of the worm and the associated worm gear are selected as a function of the friction of the worm and the worm gear, so that back forces acting from the worm gear against the worm will lock the gears against motion until the back forces are reduced to a level that the drive motor 76 is able to overcome.

Thus, in operation, when a change in position of the mechanism control member is desired, drive motor 76 is operated to rotate the worm 78 and the associated worm gear 82 in the desired direction. A spiral torque biasing spring 84 is applied to the worm gear 82 (or the control shaft 74) to bias the drive forces so as to balance the positive and negative control shaft torque peaks so that the actuator is subjected to equal positive and negative torques. The biasing spring 84 will thus balance the system time response in both directions of actuation.

When the torque peaks are too high in the direction against the rotation of the motor, the worm drive will lock up, stalling the motor until the momentary torques are reduced and the motor again drives the mechanism in the desired direction with the assistance of torque reversals acting in the desired direction. The result is that a relatively low powered motor is able to provide the desired driving action of the control shaft and actuate the mechanisms with a relatively efficient expenditure of power. If used, the return spring 80 is installed so as to cause the actuation system to default to a low lift position during engine shutdown.

Figure 8:
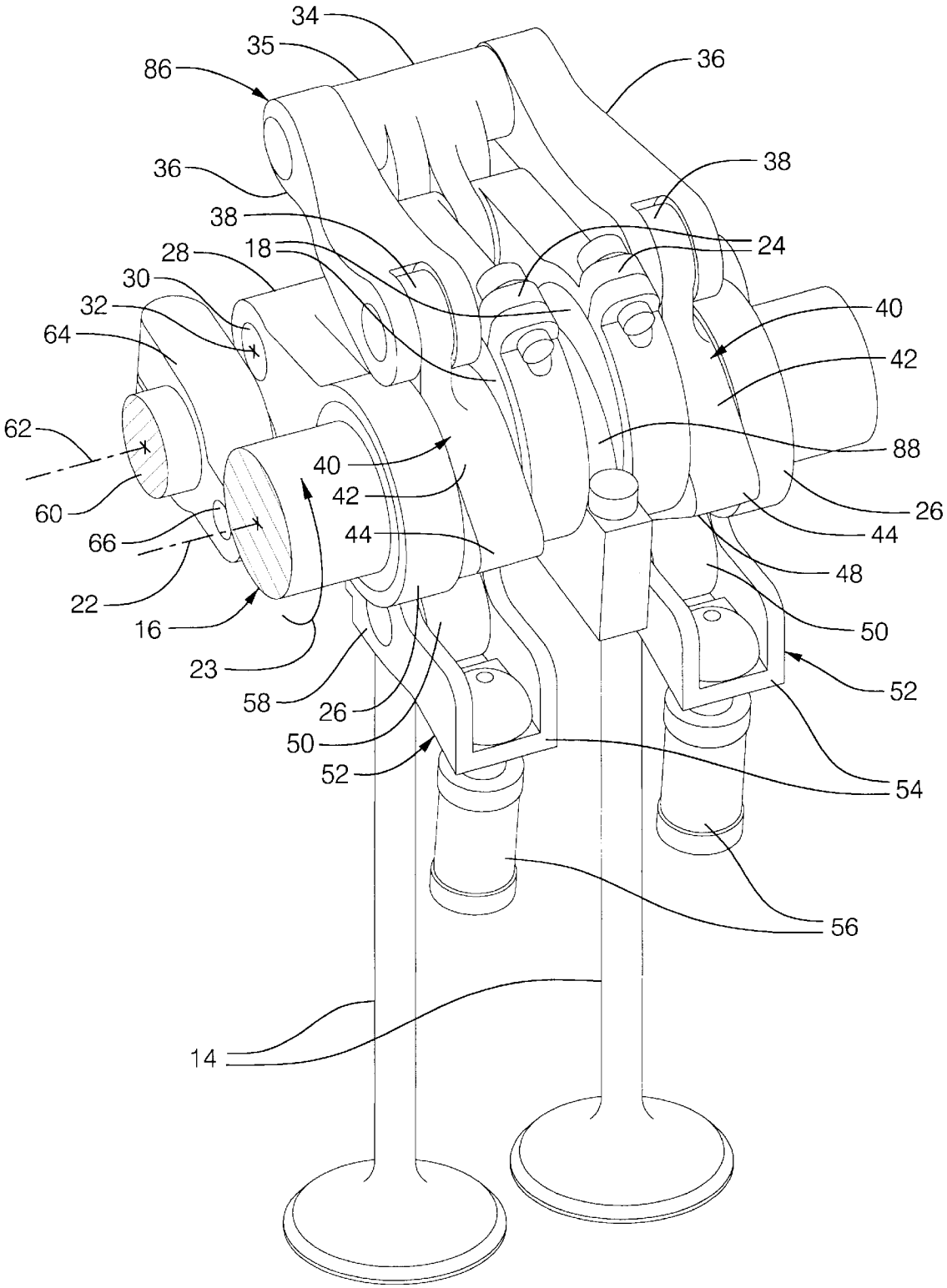
FIG. 8 is a pictorial view similar to FIG. 1 but showing an alternative embodiment of mechanism according to the invention having dual cranks on either side of a central crankshaft bearing.

Referring now to FIG. 8, there is shown an engine 85 with an alternative embodiment of valve actuating mechanism 86 similar in many respects to mechanism 12 of FIGS. 1–6 and wherein like numerals indicate like parts. The embodiment of FIG. 8 differs from that of the first embodiment primarily in the provision of a central crankshaft bearing 88 and the use of dual eccentric cranks 18 connected with dual connecting rods 24 located laterally on either side of the crankshaft bearing 88. The outer or distal ends of the connecting rods 24 each connect with the rocker lever 34 intermediate its ends as does the single connecting rod 24 of the first described embodiment.

Figure 1:
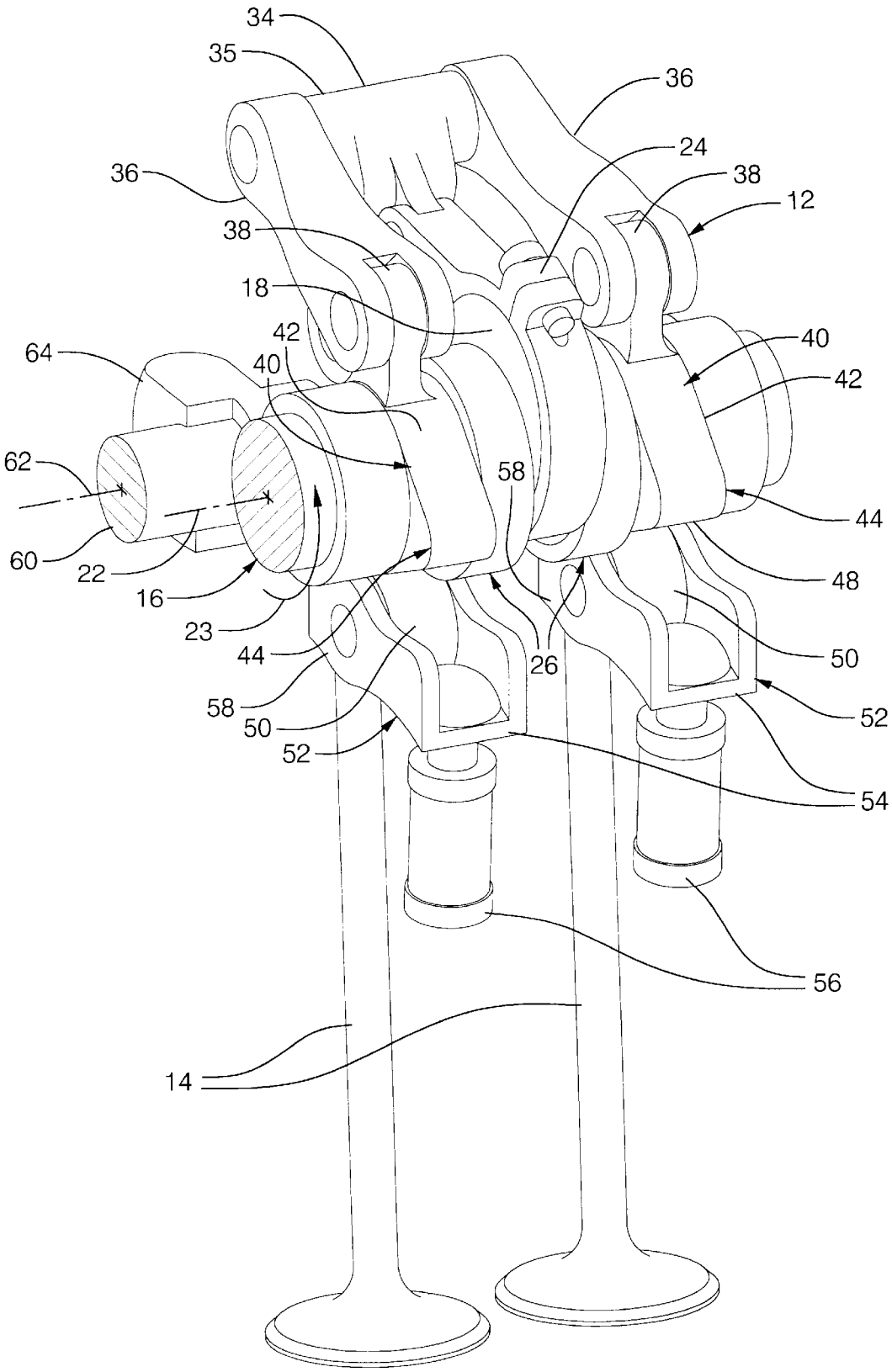
FIG. 1 is a pictorial view of a first embodiment of crank driven VVT mechanism according to the invention having a single crank drive.

In addition, the pictorial view of FIG. 8 differs from that of FIG. 1 in that the dual control members or frames 26 are positioned outward of the oscillating cams 44 in the mechanism 86, whereas, in the embodiment of FIG. 1, the frames 26 are inside the cams 44.

An advantage of the embodiment of FIG. 8 is that the crankshaft 16 is supported at the center of the mechanism 86 where the main loads are transmitted between the cranks 18 and the connecting rods 24 so that the structure is better able to support the varying loads at their source rather than on bearings spaced completely outward of the mechanism itself, as is the case in the embodiment of FIG. 1.

In other ways, the construction and operation of the embodiment of FIG. 8 is like that of the embodiment of FIGS. 1 and 2 so that further description is believed unnecessary.

It should be apparent that the mechanisms illustrated, and many of their features, could take various forms as applied to other engine applications. For example, a single VVT mechanism could be applied to each finger follower or to direct acting followers of an engine, so that the valves could be actuated differently. Alternatively, dual actuators could be installed in a single bank of valves that could allow separate inlet valve control between two inlet valves of each cylinder. In another alternative, one actuator per bank of valves could be applied, but different profiles on the individual oscillating cams of each cylinder could allow one valve to have a smaller maximum lift than the other, so that the valve timing between the two valves could be changed as desired. Such an arrangement would enable low speed charge swirl while still maintaining a single computer controlled actuator. If desired, the mechanism of the invention could also be applied to the actuation of engine exhaust valves or other appropriate applications.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. Valve actuating mechanism comprising:

a rotary crank rotatable about a primary axis;

a control member pivotable about said primary axis and including a first pivot axis spaced from said primary axis;

a primary lever connected with said control member and pivotable about said first pivot axis, said primary lever having a distal end, and a connecting rod connecting said rotary crank with said primary lever intermediate said distal end and said first pivot axis for positively oscillating said primary lever about the first pivot axis without requiring return spring means; and a pair of secondary levers each having one end pivotable about said primary axis, said one ends including oscillating cams engaging separate valve actuating members for actuating dual valves and having base circle portions and valve lift portions, the secondary levers having distal ends operatively connected with the distal end of said primary lever;

said control member being movable between a first angular position wherein the valve lift portions and the base circle portions of said oscillating cams alternately engage their respective valve actuating members for fully opening and closing associated valves with intermediate dwell periods and a second angular position wherein primarily the base circle portions of said oscillating cams engage the valve actuating members for providing minimal opening and closing movement of said associated valves.

2. Valve actuating mechanism as in claim 1 wherein the operative connection of the primary and secondary levers is through a link connected between the distal ends of said levers.

3. Valve actuating mechanism as in claim 1 including a control lever pivotable about a secondary axis and connected to the control member through a slide and slot connection arranged such that angular motion of the control lever relative to the control member has a relatively higher angular ratio in a low valve lift range than in an intermediate valve lift range.

4. Valve actuating mechanism as in claim 3 wherein said angular ratio has a maximum ratio more than twice the minimum ratio.

5. Valve actuating mechanism as in claim 3 wherein a slot is formed in the control member and a slide includes a pin on the control lever and operatively engaging the slot, the slot being angled from a radial direction to provide the higher angular ratio in the low valve lift range.

6. Valve actuating mechanism as in claim 5 including a flat sided bushing on the pin and slidably engaging the slot.

7. Valve actuating mechanism as in claim 1 including a control shaft operatively engaging the control member for pivotal movement between said first and second angular positions; and a control shaft actuator operatively connected to selectively provide powered rotation of the control shaft, said actuator including means for preventing rotation of the control shaft opposite a direction of selected powered rotation.

8. Valve actuating mechanism as in claim 7 wherein the control shaft actuator is a worm drive having worm tooth angles selected to prevent back driving of the actuator from mechanism forces applied against the control shaft.

9. Valve actuating mechanism as in claim 1 wherein said valve actuating members are finger followers.

10. Valve actuating mechanism comprising:

a rotary crank rotatable about a primary axis;

a control member pivotable about said primary axis and including a first pivot axis spaced from said primary axis;

a primary lever connected with said control member and pivotable about said first pivot axis, said primary lever having a distal end, and a connecting rod connecting said rotary crank with said primary lever intermediate said distal end and said first pivot axis for positively oscillating said primary lever about the first pivot axis without requiring return spring means; and a secondary lever having one end pivotable about said primary axis, said one end including an oscillating cam engaging a valve actuating member for actuating an associated valve and having a base circle portion and a valve lift portion, the secondary lever having a distal end operatively connected with the distal end of said primary lever;

said control member being movable between a first angular position wherein the valve lift portion and the base circle portion of said oscillating cam alternately engage said valve actuating member for fully opening and closing said valve with intermediate dwell periods and a second angular position wherein primarily the base circle portion of said oscillating cam engages the valve actuating member for providing minimal opening and closing movement of said valve.

11. Valve actuating mechanism as in claim 10 wherein the operative connection of the primary and secondary levers is through a link connected between the distal ends of said levers.

12. Valve actuating mechanism as in claim 10 including a control lever pivotable about a secondary axis and connected to the control member through a slide and slot connection arranged such that angular motion of the control lever relative to the control member has a relatively higher angular ratio in a low valve lift range than in an intermediate valve lift range, wherein a slot is formed in the control member and a slide includes a pin on the control lever and operatively engaging the slot, the slot being angled from a radial direction to provide the higher angular ratio in the low valve lift range.

13. Valve actuating mechanism as in claim 10 including a control shaft operatively engaging the control member for pivotal movement between said first and second angular positions; and a control shaft actuator operatively connected to selectively provide powered rotation of the control shaft, said actuator including means for preventing rotation of the control shaft opposite a direction of selected powered rotation.

* * * * *